US008511679B2

(12) United States Patent
Kimura et al.

(10) Patent No.: US 8,511,679 B2
(45) Date of Patent: Aug. 20, 2013

(54) SHEET PROCESSING DEVICE

(75) Inventors: Kuniaki Kimura, Kiryu (JP); Kenichi Watanabe, Kiryu (JP)

(73) Assignee: Gradco (Japan) Ltd., Tokyo (JP)

( * ) Notice: Subject to any disclaimer, the term of this patent is extended or adjusted under 35 U.S.C. 154(b) by 0 days.

(21) Appl. No.: 13/494,592

(22) Filed: Jun. 12, 2012

(65) Prior Publication Data

US 2012/0299238 A1 Nov. 29, 2012

Related U.S. Application Data

(63) Continuation of application No. 12/478,803, filed on Jun. 5, 2009, now abandoned.

(51) Int. Cl.
*B65H 31/36* (2006.01)

(52) U.S. Cl.
USPC ..... 271/221

(58) Field of Classification Search
USPC .... 271/220–224, 207; 270/58.12; 414/791.2
See application file for complete search history.

(56) References Cited

U.S. PATENT DOCUMENTS 5,188,353 A * 2/1993 Parks ..... 271/184
6,619,653 B2 * 9/2003 Dobrindt ..... 271/83

FOREIGN PATENT DOCUMENTS

JP 60-2566 * 1/1985
JP 4-125251 * 4/1992

* cited by examiner

*Primary Examiner* — Thomas Morrison
(74) *Attorney, Agent, or Firm* — Flynn, Thiel, Boutell & Tanis, P.C.

(57) ABSTRACT

A sheet processing device in the form of an offset stacker, a sheet fence (103, 104) is provided on a side of sheets (S) to be processed stacked on a stack tray (3) opposite from a jogger (101, 102) so that the sheet fence accurately defines a final offset position of the sheets. When a transient offset position at which the sheets are stacked on the stack tray varies from one sheet to another, the side edges of sheets selected for offset stacking can be lined up without fail owing to the jogging action of the jogger and the supporting action of the sheet fence. A pair of joggers may be arranged on either side of the sheets, along with a pair of corresponding sheets fences on the opposing sides. The jogger and sheet fence on a same side may be supported by a common moveable frame (107, 108).

4 Claims, 7 Drawing Sheets

SHEET PROCESSING DEVICE

This is a continuation of prior U.S. application Ser. No. 12/478,803, filed Jun. 5, 2009 now abandoned.

FIELD OF THE INVENTION

The present invention relates to a sheet processing device for transporting a plurality of sheets and stacking them on a sheet table such as a stack tray selectively at transversely offset positions with respect to a sheet transporting direction.

BACKGROUND OF THE INVENTION

To facilitate the handling of sheets such as paper sheets which are ejected from an imaging device such as photocopiers and printers, it is desirable to use an offset stacker that stacks the sheets on a stack table as individual sets that are transversely offset from one set to another. Japanese patent laid open publications JP2003-312931A (patent document 1) and JP2003-341908A (patent document 2) disclose such offset stackers.

In such an offset stacker, typically, a transversely moveable jogger is used for jogging of pushing each sheet to a transversely offset position with respect to the transport direction of the sheet. See patent document 1, for instance.

However, according the prior art, as the jogger pushes each sheet transversely, the offset distance could vary from one sheet to another owing to the unevenness in the frictional property between the sheets. Therefore, the side edges of the sheets in each set may not be lined up evenly, and this may cause some inconvenience in the subsequent handling of each set of sheets.

BRIEF SUMMARY OF THE INVENTION

In view of such problems of the prior art, a primary object of the present invention is to provide a sheet processing device such as an offset stacker that can transport a plurality of sheets and stack the sheets on a stack table as individual sets that are transversely offset from one set to another and contain sheets with highly neatly lined up side edges.

According to the present invention, such an object can be accomplished by providing a sheet processing device for transporting sheets having first side edges and second side edge in a sheet transporting direction and stacking the sheets on a stack tray selectively at a regular position and at least one transversely offset position, comprising: an offset transport unit configured to eject sheets onto the stack tray selectively at the regular position and a first transitional offset position which is more transversely offset than a first final offset position; a first jogger provided on a first side of the stack tray to jog the first side edges of first selected sheets; and a first sheet fence provided on a second side of the stack tray to support the second side edges of the first selected sheets; wherein the first sheet fence is positioned to support the first selected sheets at the first final offset position when the first side edges are jogged by the first jogger.

Because the first final offset position is defined by the first sheet fence, even when the transient offset position at which the sheets are stacked on the stack tray varies from one sheet to another and/or the jogging action produces uneven results, the side edges of the first selected sheets can be lined up by the jogging action of the first joggers without fail.

According to a preferred embodiment of the present invention, the sheet processing device further comprises a second jogger provided on the second side of the stack tray to jog the second side edges of second selected sheets; and a second sheet fence provided on the first side of the stack tray to support the first side edges of the second selected sheets; wherein the offset transport unit is additionally configured to eject sheets to a second transitional offset position which is more transversely offset than a second first final offset position, the second final offset position being offset from the regular position opposite to the first final offset position; and the second sheet fence is positioned to support the second selected sheets at the second final offset position when the second side edges are jogged by the second jogger.

Thereby, the side edges of the sheets can be neatly lined up at two different offset positions, and this enhances the convenience of the present invention. According to a certain embodiment of the present invention, the first jogger and first sheet fence are used for a simple stack mode in which the sheets are always stacked at a regular position, and the second jogger and second sheet are selectively used for an offset stack mode which is transversely offset from the regular position. It is also possible not to use the joggers and sheet fences in a simple stack mode by stacking the sheets directly at a regular position. The first jogger and first sheet fence are used for a first offset stack mode in which the sheet stack is offset in a first transverse direction, and the second jogger and second sheet fence are used for a second offset stack mode in which the sheet stack is offset in a second transverse direction which is opposite to the first transverse direction.

According to a certain aspect of the present invention, the second jogger is located transversely further away from the sheets than the first sheet fence, and the first jogger is located transversely further away from the sheets than the second sheet fence, the first and second sheet fences being configured to be raised selectively so as not to interfere with transportation of sheets to the stack tray. Thereby, space requirements are minimized. In this case, it is preferable if the first and second sheet fences comprise fence members each provided with an upper end pivotally supported by a moveable frame and a free end that can be placed on a sheet stack of the stack tray, each fence member extending obliquely downward in a downstream direction, so that the sheet fences may be pushed out of the way by the incoming sheets without requiring any complex powered arrangement.

According to a particularly preferred embodiment of the present invention, the first jogger and second sheet fence are both attached to a first moveable frame configured to be moved transversely with respect to the sheet transporting direction to effect a jogging movement of the first jogger and to adjustably define the second final offset position; and the second jogger and first sheet fence are both attached to a second moveable frame configured to be moved transversely with respect to the sheet transporting direction to effect a jogging movement of the second jogger and to adjustably define the first final offset position.

Thereby, the jogging action and sheet fence adjustment can be achieved by a common structure and a common drive unit.

BRIEF DESCRIPTION OF THE DRAWINGS

Now the present invention is described in the following with reference to the appended drawings, in which.

DETAILED DESCRIPTION OF THE INVENTION

Figure 1:
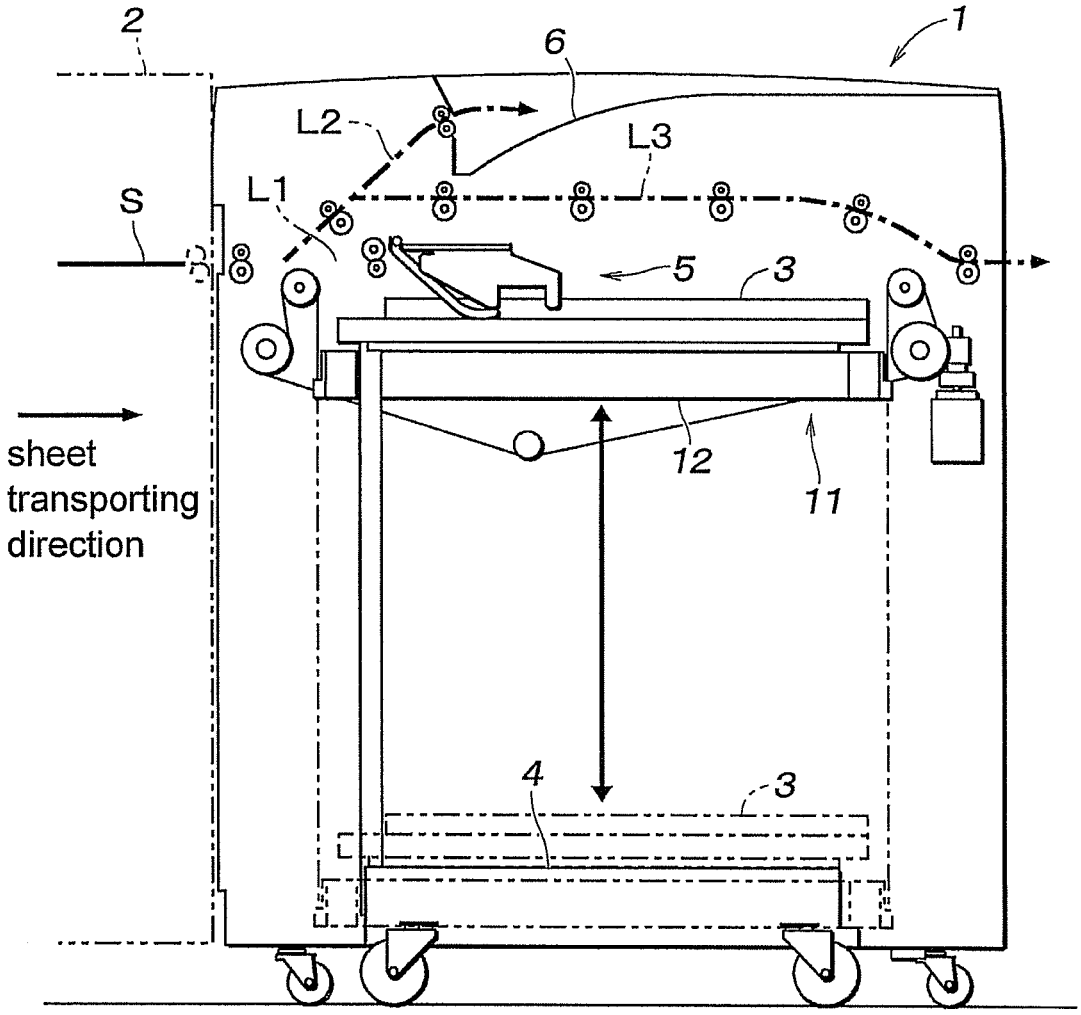
FIG. 1 is a simplified front view of a sheet processing device embodying the present invention.

FIG. 1 illustrates an offset stacker embodying the present invention. This stacker 1 may be used, for instance, in a printing system for on-demand printing, and comprises a stack tray (sheet table) 3 which supports a stack of paper sheets S ejected from an imaging device 2 such as a photocopier, printer or the like located on the left hand side of FIG. 1 and a dolly 4 which is configured to carry the stack tray 3 supporting the paper stack and carrying it out of the stacker 1. In the following description, the side of the system facing the user is referred to as a front side (FIG. 1), and the side of the system facing away from the user is referred to as a rear side. The sheets are transported from left to right or in a sheet transporting direction as seen from the user.

The stacker 1 further comprises a sheet processing unit 5 for placing the paper sheets S on the stack tray 3 with their edges in a properly lined-up condition as will be described hereinafter. The paper sheets S ejected from the imaging device 2 are transported to the sheet processing unit 5 via a sheet transport passage L1 fitted with rollers or other means for transporting paper sheets.

The stacker 1 is configured to stack paper sheets S either in a simple stack mode or an offset stack mode as desired. In the simple stack mode, the paper sheets S are stacked strictly on a standard position of the stack tray 3. In the offset stack mode, the paper sheets S may be stacked in a position slightly offset from the standard position in a direction (transverse direction) perpendicular to the direction of transporting the paper sheets S as required.

This stacker 1 is additionally configured to operate in a top-pass ejection mode and a bypass mode. In the top-pass ejection mode, each sheet S is ejected onto an upper tray 6 located at an uppermost part of the stacker via a corresponding sheet transport passage L2. In the bypass mode, each sheet S is ejected out of the stacker 1 via a corresponding sheet transport passage L3, and is passed on to another device such as a second stacker that may be connected to a downstream end of the stacker 1.

In the illustrated embodiment, the stacker 1 includes a tray lift mechanism 11 that can raise and lower a tray lift table 12 supporting the stack tray 3 to a height corresponding to the number of paper sheets S stacked on the stack tray 3. The height of the tray lift table 12 may be determined by counting the number of paper sheets S stacked on the stack tray 3, and lowering the tray lift table 12 by a corresponding distance. Thereby, the stack tray 3 can be maintained at a height that is suitable for receiving the sheets S transported through the sheet transport passage L1.

Figure 2:
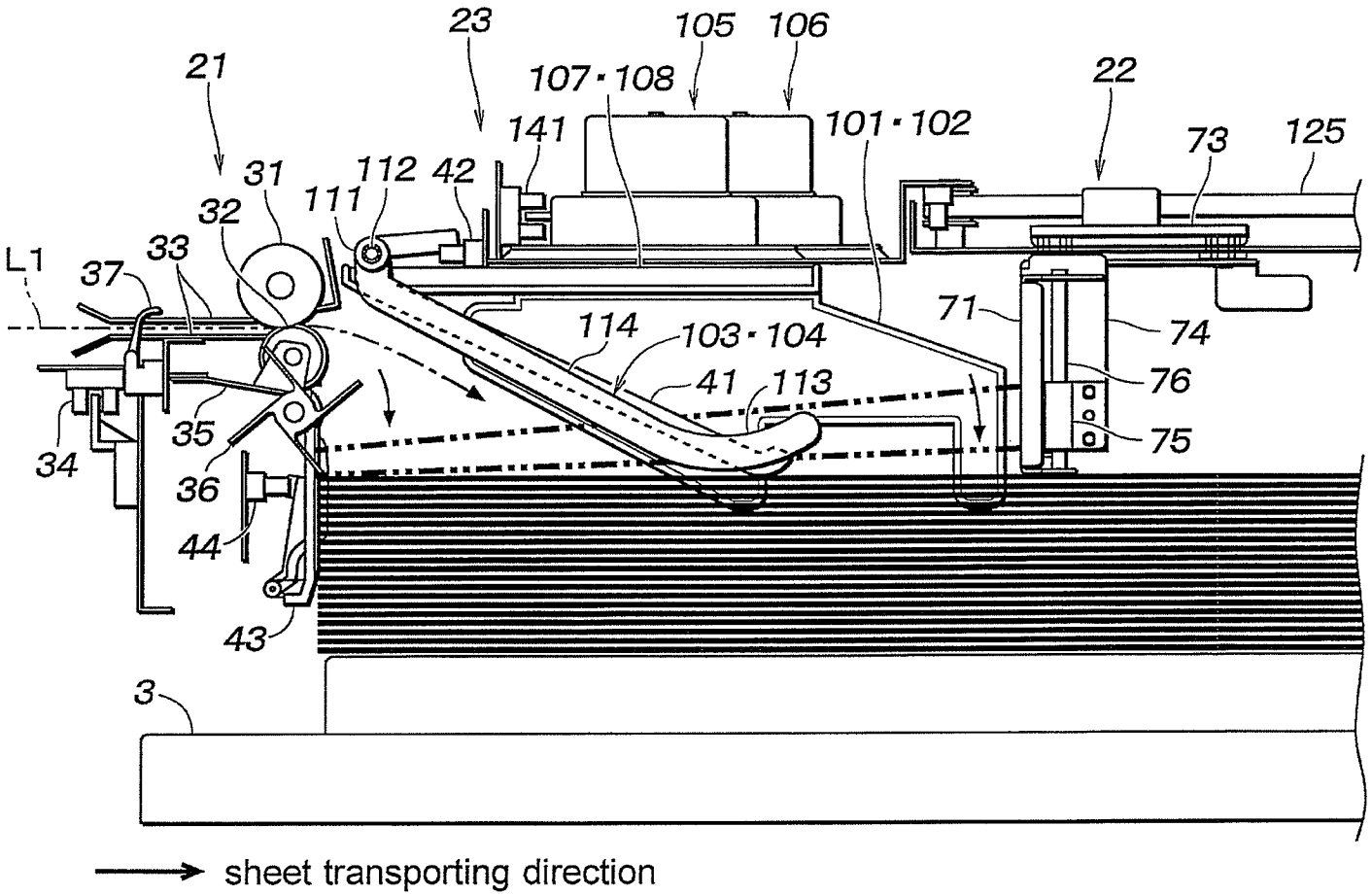
FIG. 2 is a fragmentary front view of the sheet processing device shown in FIG. 1.

FIG. 2 is a front view of the sheet processing unit 5 shown in FIG. 1. The sheet processing unit 5 comprises an offset transport unit 21 for transporting or ejecting paper sheets S onto the stack tray 3 in a transversely offset relationship as required, a first sheet lineup unit 22 for lining up the paper sheets S in the sheet transporting direction and a second sheet lineup unit 23 for lining up the paper sheets S in the transverse direction or in the direction perpendicular to the sheet transporting direction.

The offset transport unit 21 comprises outlet rollers 31, pinch rollers 32 nipping the paper sheets S in cooperation with the corresponding outlet rollers 31 and a moveable frame 33 supporting the outlet rollers 31 and pinch rollers 32. The moveable frame 33 is in turn supported by a fixed frame (not shown in the drawing) so as to be moveable in the transverse direction (perpendicular to the paper plane of FIG. 2). Adjacent to the moveable frame 33 is provided a detector 34 for detecting the axial position of the outlet rollers 31 and pinch rollers 32, and the detected signal is used for the purpose of controlling the positions of these rollers.

The outlet rollers 31*a* are integrally and commonly supported by a shaft 65 (FIG. 3) which is in turn rotatably supported by the moveable frame 33. Each pinch roller 32 is resiliently and individually supported by the moveable frame 33 via a sheet spring 35, and is urged thereby against the corresponding outlet roller 31. A paddle wheel 36 provided under each outlet roller 31 turns in synchronism with the outlet roller 31. Each paddle wheel 36 strikes the rear edge of each paper sheet S ejected onto the stack tray 3, and forces it downward. A detector 37 for detecting the passage of each sheet S transported along the sheet transport passage L1 is provided at an upstream end of the outlet rollers 31.

Above the stack tray 3 is provided a first sensor bar 41 having a base end pivotally supported by a fixed frame, and extending obliquely downwardly and toward the downstream direction. The free end of the first sensor bar 41 rests upon the paper sheet stack S on the stack tray under the gravitational force, and a first detector 42 for detecting the movement of the first sensor bar 41 is provided on the fixed frame adjacent to the sensor bar 41. Below the outlet rollers 31 is provided a second sensor bar 43 having a lower end pivotally supported by the fixed frame and extending substantially upright so as to be engaged by the trailing edge of the paper sheets on the stack tray 3. Adjacent to the second sensor bar 43 is provided a second detector 44 for detecting the movement of the second sensor bar 43. The presence of paper sheets S on the stack tray 3 and the height thereof can be determined from the detection signals of the detectors 42 and 44 and the vertical position of the stack tray 3.

Figure 3:
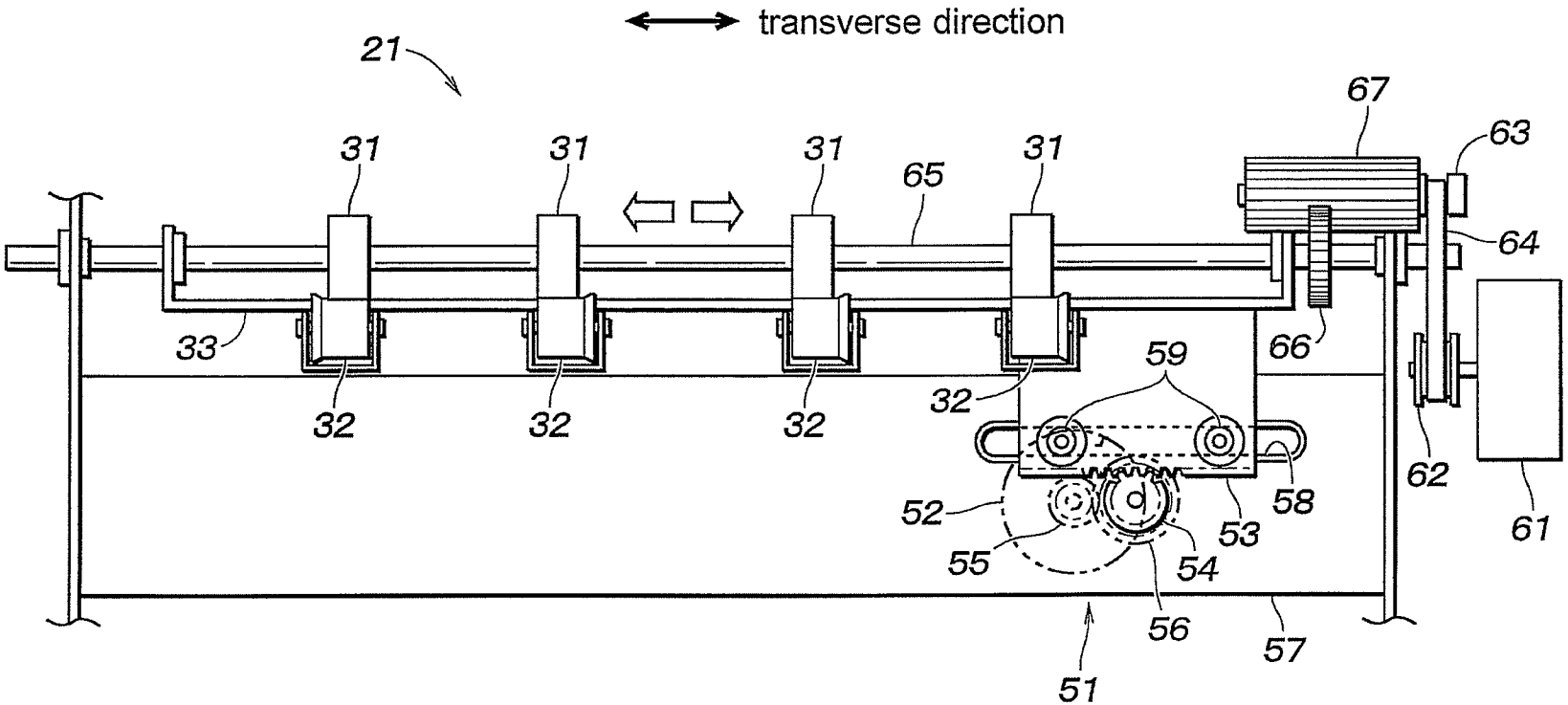
FIG. 3 is a side view of the offset transport unit shown in FIG. 2.

FIG. 3 is a side view of the offset transport unit 21 shown in FIG. 2. The offset transport unit 21 comprises a drive unit 51 for transversely moving the moveable frame 33, along with the outlet rollers 31 and pinch rollers 32, so that the outlet rollers 31 and pinch rollers 32, with a paper sheet nipped between them, can be moved by a small distance in the axial (transverse) direction, and the paper sheets S can be ejected onto the stack tray 3 in a transversely offset relationship.

The drive unit 51 incorporates a rack and pinion mechanism for producing a linear movement, and causes the axial movement of the outlet rollers 31 and pinch rollers 32. The drive unit 51 includes an electric motor 52, a rack member 53 having a rack formed along the lower edge thereof and extending in parallel with the shaft 65 integrally supporting the outlet rollers 31, a pinion 54 meshing with the rack of the rack member 53, and reduction gears 55 and 56 interposed between the output shaft of the electric motor 52 and pinion 54.

The rack member 53 is connected to the moveable frame 33, and is integrally provided with a pair of sliders 59 sliding along a guide slot 58 formed in the fixed frame 57 in parallel with the shaft 65 so that the rack member 53 moves along the guide slot 58 as the motor 52 is actuated in either direction.

Thereby, the outlet rollers 31 and pinch rollers 32 are enabled to move in either axial direction.

The outlet rollers 31 are actuated by an electric motor 61. The actuating force of the electric motor 61 is transmitted from a pulley 62 on the output shaft of the motor 61 to a pulley 63 connected to a drive gear 67 via an endless belt 64. The drive gear 67 meshes with a driven gear 66 coaxially attached to an end of the shaft 65 integrally supporting the outlet rollers 31 so that the outlet rollers 31 are turned as the electric motor 61 is actuated. The drive gear 67 is elongated in the axial direction so that the meshing between the drive gear 67 and driven gear 66 is maintained even when the driven gear 66 along with the shaft 65 is actuated over the entire stroke thereof by the drive unit 51.

Figure 4:
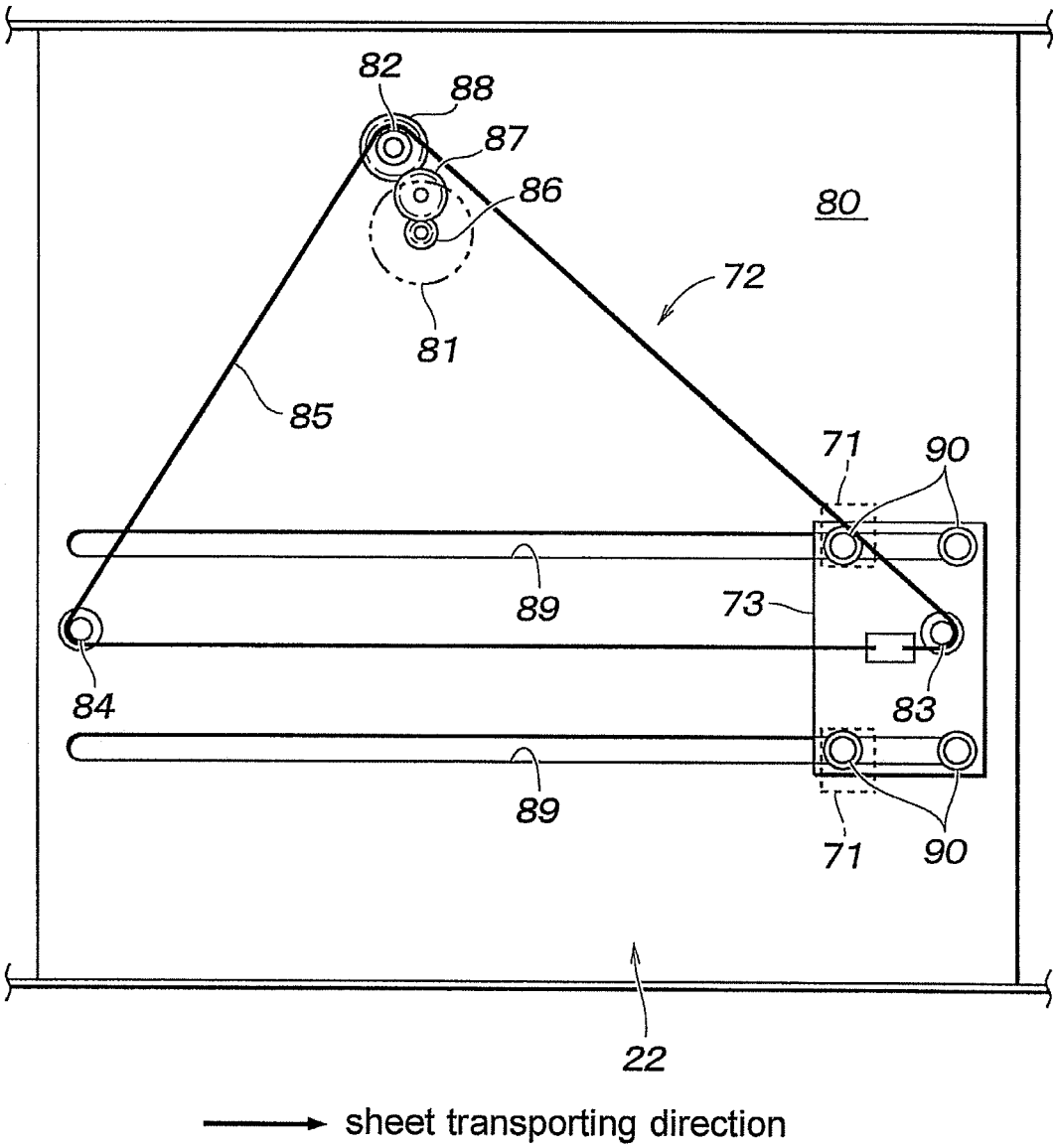
FIG. 4 is a plan view showing the first sheet lineup unit shown in FIG. 2.

FIG. 4 is a plan view of the first sheet lineup unit 22 shown in FIG. 2 which lines up or makes even the leading edges of the paper sheets S in the sheet transporting direction. The first sheet lineup unit 22 comprises a pair of stoppers 71 that engage the leading edges of the paper sheets S ejected from the offset transport unit 21 to the stack tray 3 and a drive unit 72 for adjusting the position of the stoppers 71.

The drive unit 72 is configured to move the support member 73 for the stoppers 71 to adjust the position of the stoppers 71 in the sheet transporting direction, and comprises an electric motor 81, pulleys 82 to 84 pivotally supported by a fixed frame 80 in a triangular arrangement, an endless belt 85 passed around these pulleys and attached to the support member 73 at a point of a section thereof extending in the sheet transporting direction, and reduction gears 86 to 88 interposed between the output shaft of the electric motor 81 and one of the pulleys 82.

The support member 73 for the stoppers 71 is provided with sliders 90 slidably guided by a pair of parallel guide slots 89 formed in the fixed frame 80 and elongated along the direction of ejecting the paper sheets S (sheet transporting direction). Thereby, as the electric motor 81 turns in either direction, the support member 73 is actuated along the guide slots 89, and this in turn causes the stoppers 71 to move in the sheet transporting direction for the adjustment of the position of the stoppers 71.

Referring to FIG. 2, each stopper 71 comprises a stem portion 76 which is received in a guide portion 75 of a base member 74 connected to the support member 73 so that the stopper 71 is moveable vertically between a lowermost position and an uppermost position over a prescribed stroke. Thus, the stoppers 71 are supported by the base member 74 in such a manner that the stoppers 71 rest upon the stack tray 3 or upon the stack of paper sheets S on the stack tray 3 under its own weight. When there is no paper sheet stack or stack tray to limit the downward movement of the stoppers 71, the guide portions 75 retain the stoppers 71 at the lowermost position thereof.

Supposed that a relatively small sheet S is stacked upon a relatively large sheet S. The stoppers 71 have been previously at the position corresponding to the leading edge of the larger sheet S. When the smaller sheet S is about to be stacked on the stack tray 3, the tray lift mechanism 11 (see FIG. 1) lowers the lift table 12 until the stoppers 71 drop to the lowermost position and are cleared from the upper surface of the paper stack, and are then moved horizontally to a position corresponding to the leading edge of the smaller sheet S. Thereafter, the lift table 12 is raised until the stoppers 71 come into engagement with the uppermost sheet on the stack tray 3, and are pushed slightly upward thereby. As a result, the leading edges of the smaller sheets that will follow the larger sheets can be lined up by the stoppers 71.

Figure 5:
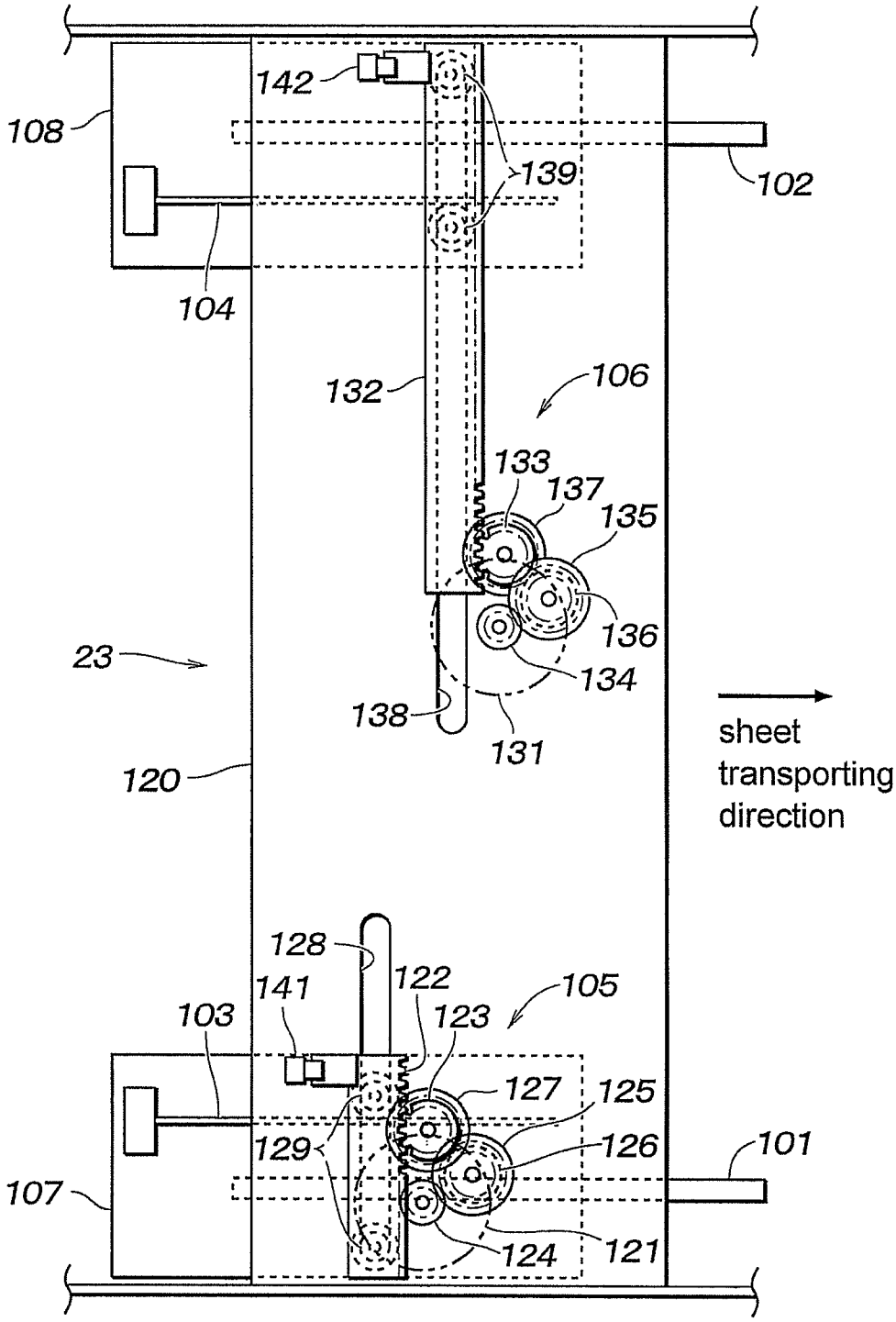
FIG. 5 is a plan view showing the second sheet lineup unit shown in FIG. 2.

FIG. 5 is a plan view of the second sheet lineup unit 23 illustrated in FIG. 2. The second sheet lineup unit 23 lines up the position of the sheets S in the transverse direction which is perpendicular to the sheet transporting direction, and comprises a front jogger 101 and rear jogger 102 for jogging each sheet to a prescribed offset position, a front sheet fence 103 and rear sheet fence 104 that engage the front and rear side edges of the paper sheet, respectively, to support the paper sheets against the jogging action performed by the corresponding joggers 101 and 102 and drive units 105 and 106 for actuating the corresponding joggers 101 and 102.

The front jogger 101 is supported by a front support member 107, and the rear jogger 102 is supported by a rear support member 108. The front sheet fence 103 is mounted on a part of the front support member 107 more inwardly or closer to the paper stack S than the front jogger 101, and the rear sheet fence 104 is mounted on apart of the rear support member 108 more inwardly or closer to the paper stack S than the rear jogger 102. Thus, the front and rear sheet fences 103 and 104 are actuated integrally with the front and rear joggers 101 and 102, respectively.

As shown in FIG. 2, each sheet fence 103, 104 comprises a rod member having a base end 111 pivotally supported by the corresponding support member 107, 108 via a pivot shaft 112 and a middle part 114 extending obliquely downward in a downstream direction and a free end 113 having a convex or otherwise smoothly curved surface facing downward. Therefore, even when each sheet fence 103, 104 is located in a position that could interfere with the sheets S ejected from the offset transport unit 21 onto the stack tray 3, the sheet fence is swung upward by the incoming sheets S, and does not prevent the sheets S to be properly stacked upon the stack tray 3.

Referring to FIG. 5, the drive unit 105 is provided for actuating the front jogger 101 transversely or in the direction perpendicular to the sheet transporting direction. The drive unit 105 comprises an electric motor 121 attached to a fixed frame 120, a rack member 122 attached to the front support member 107 and provided with a rack extending in the transverse direction, a pinion 123 meshing with the rack and a plurality of reduction gears 124 to 127 interposed between the output shaft of the electric motor 121 and the pinion 123. The rack member 122 is provided with a pair of sliders 129 guided by a transversely extending guide slot 128 formed in the fixed frame 120. Thus, the rack member 122 and front support member 107 are actuated in either transverse direction while the sliders 129 are guided by the guide slot 128 as the electric motor 131 is actuated in a corresponding direction, and this causes the front jogger 101 to perform the prescribed jogging movement in the transverse direction.

Similarly, the drive unit 106 is provided for actuating the rear jogger 102 transversely or in the direction perpendicular to the sheet transporting direction. The drive unit 106 comprises an electric motor 131 attached to the fixed frame 120, a rack member 132 attached to the rear support member 108 and provided with a rack extending in the transverse direction, a pinion 133 meshing with the rack and a plurality of reduction gears 134 to 137 interposed between the output shaft of the electric motor 131 and the pinion 133. The rack member 132 is provided with a pair of sliders 139 guided by a transversely extending guide slot 138 formed in the fixed frame 120. Thus, the rack member 132 and front support member 108 are actuated in either transverse direction while the sliders 139 are guided by the guide slot 138 as the electric motor 131 is actuated in a corresponding direction, and this causes the rear jogger 102 to perform the prescribed jogging movement in the transverse direction.

Adjacent to the front rack member 122 is provided a position detector 141 for detecting the current position of the rack member 122. The position of the front jogger 101 can be adjusted according to the output signal of the position detector 141 and a control signal from the electric motor 121. Similarly, adjacent to the rear rack member 132 is provided a position detector 142 for detecting the current position of the rack member 132. The position of the rear jogger 102 can be adjusted according to the output signal of the position detector 142 and a control signal from the electric motor 131. As can be appreciated from the foregoing and following description, at each given moment while the offset stacking mode is in progress, only one of the joggers 101 and 102 is actuated by the corresponding drive unit. The other drive unit can be conveniently used for positioning the sheet fence for the particular offset stack mode.

FIGS. 6 and 7 are side views (as seen from the downstream end of the sheet transporting direction) showing the sequential states of the sheet processing unit 5 shown in FIG. 2. FIG. 6 illustrates the case where the sheets S are offset toward the front side, while FIG. 7 illustrates the case where the sheets S are offset toward the rear side.

Figure 6A:
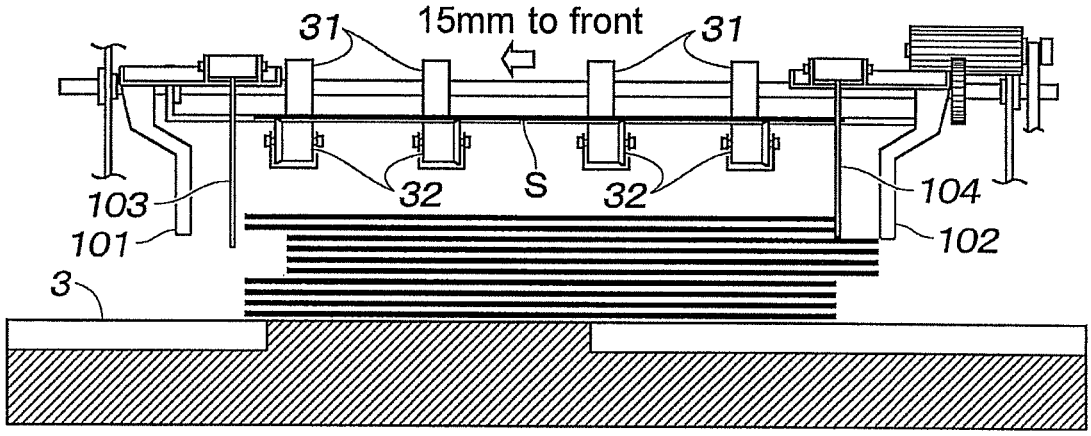
FIGS. 6A to 6C are fragmentary side views showing the sequential steps of stacking sheets on the stack tray at a position offset toward the front.
Figure 6B:
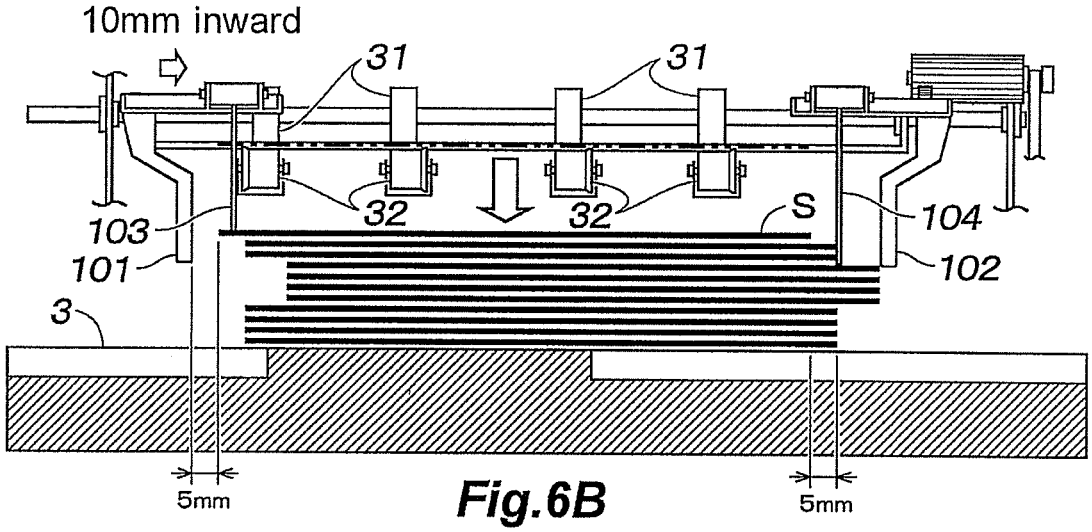

Referring to FIG. 6A, when the sheets S are desired to be offset toward the front side, the sheets S ejected from the imaging device are forwarded to the outlet rollers 31 and pinch rollers 32 which are at their neutral positions. At this time, the front support member 107 supporting the front jogger 101 and front sheet fence 103 is at an outermost (frontmost) position thereof. The rear support member 108 supporting the rear jogger 102 and rear sheet fence 104 is at a prescribed offset position which is slightly more inwardly located than an outermost (rearmost) position thereof. When the trailing edge of an incoming sheet S is detected by the detector 37 (see FIG. 2) located at the inlet end of the outlet rollers 31 or the sheet S is fully pulled into the sheet processing unit 5, following a prescribed short waiting time period, the outlet rollers 31 and pinch rollers 32 are shifted transversely toward the front by a prescribed distance (15 mm, for instance) while the incoming sheet S is being nipped by the rollers 31 and 32, and this causes the incoming sheet S to be stacked upon the stack tray 3 at a correspondingly transversely offset position on the stack tray 3 which is more offset than a final offset position as shown in FIG. 6B. At this time, the incoming sheet S pushes up the front sheet fence 103 to move it out of the way of the incoming sheet to be stacked upon the stack tray 3, and the free end of the sheet fence 103 rests upon the sheet S once the sheet S has been stacked upon the stack tray 3.

Figure 6C:
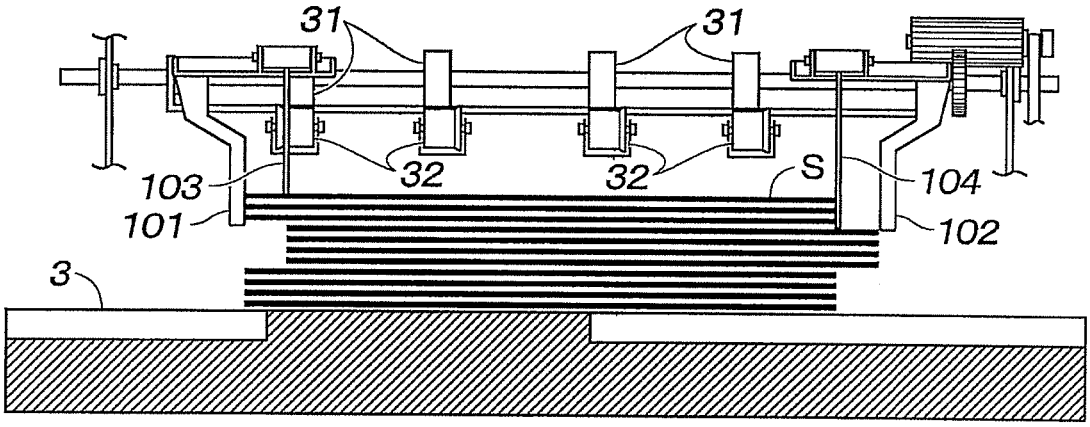

Thereafter, the front jogger 101 is actuated toward the opposing side edge of the sheet S by a prescribed distance (10 mm, for instance). This causes the sheet S to be pushed into engagement with the rear sheet fence 104, and reach the final offset position toward the front as shown in FIG. 6C. The final offset position is offset by 5 mm (=15 mm−10 mm) from the regular position at which the paper sheet S would have been stacked if the outlet rollers 31 and pinch rollers 32 were at their neutral position. Therefore, even when there are some variations in the positions of the sheets stacked upon the stack tray 3 in the offset stack mode, the front jogger 101 jogs or pushes them toward the final offset position in cooperation with the rear fence 104.

Figure 7A:
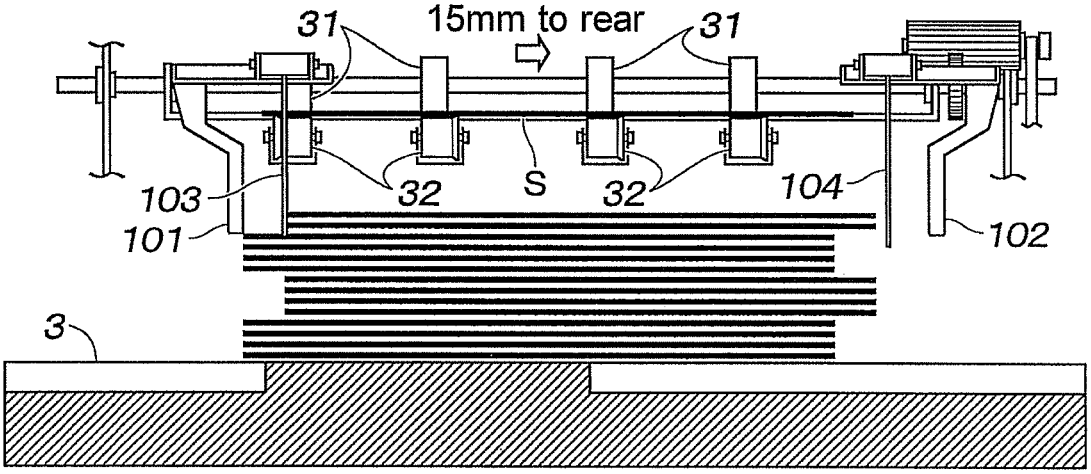
FIGS. 7A to 7C are fragmentary side views showing the sequential steps of stacking sheets on the stack tray at a position offset toward the rear.
Figure 7B:
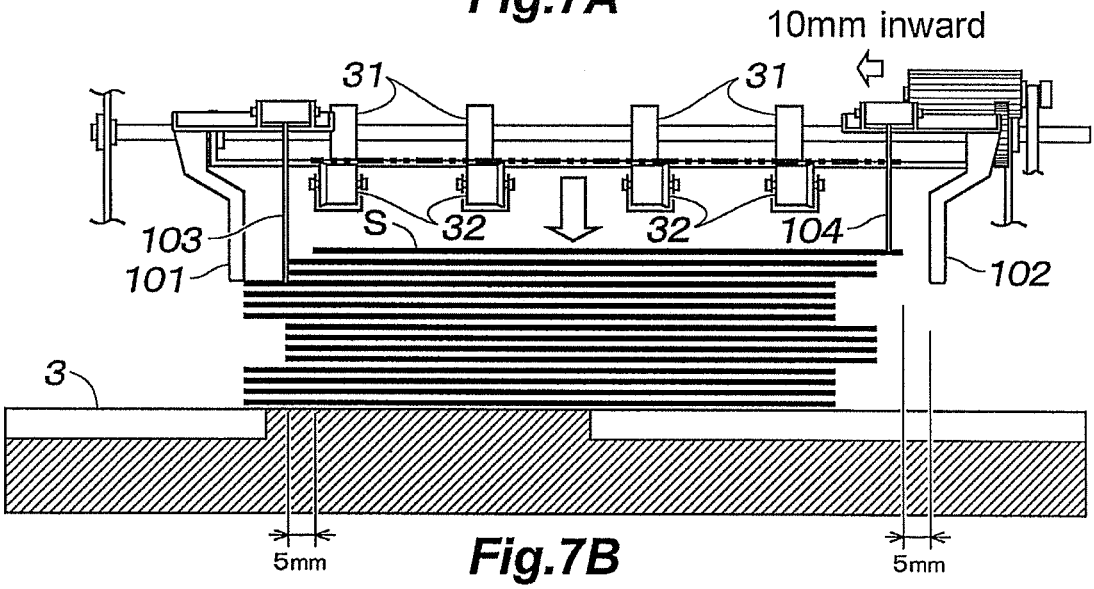
Figure 7C:
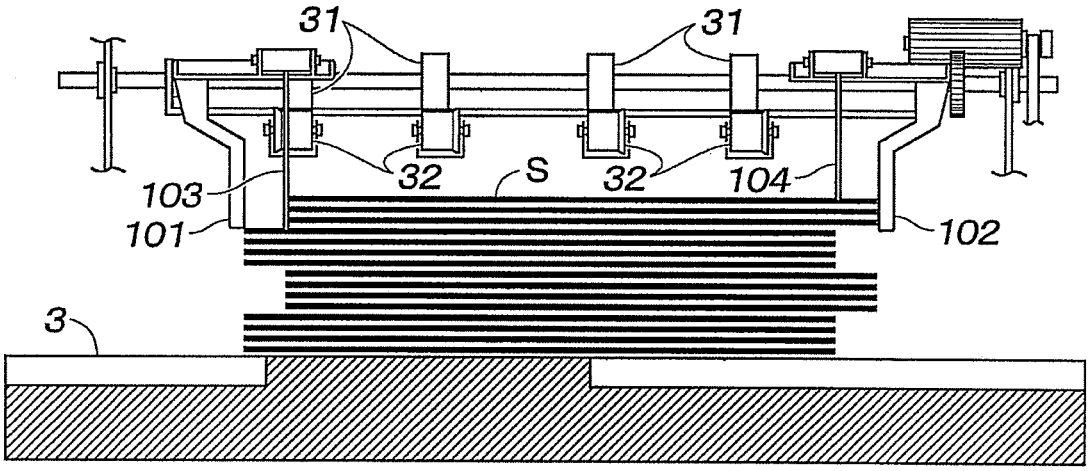

When the sheets S are desired to be stacked upon the stack tray 3 at a position offset toward the rear, it can be accomplished in a similar fashion with appropriate modifications. When the incoming sheet S is about to be stacked upon the stack tray 3 but is still nipped between the outlet rollers 31 and pinch rollers 32, the outlet rollers 31 and pinch rollers 32 are shifted toward the rear by a prescribed distance (15 mm, for instance) as shown in FIG. 7A. Once the incoming sheet S is stacked upon the stack tray 3, the rear jogger 102 is moved inwardly by a prescribed distance (10 mm, for instance) as illustrated in FIG. 7B. This causes the incoming sheet S to be pushed against the front sheet fence 103 and to reach the prescribed final offset position as illustrated in FIG. 7C.

When all the sheets are desired to be stacked at a same position, it is possible to position the outlet rollers 31 and pinch rollers 32 at the neutral position, and eject the sheets S onto the stack tray 3 without using the joggers, or to offset all the sheets to the front or rear final offset position by using the corresponding jogger.

Although the present invention has been described in terms of a preferred embodiment thereof, it is obvious to a person skilled in the art that various alterations and modifications are possible without departing from the scope of the present invention which is set forth in the appended claims.

The contents of the original Japanese patent application which is published as Japanese patent laid open publication No. 2008-308243 as well as those of the prior art mentioned in the disclosure are incorporated in this application by reference.

What is claimed is:

1. A sheet processing device for stacking sheets on a stack tray at a transversely offset position with respect to a sheet transporting direction, comprising:

an offset transport unit configured to eject sheets onto the stack tray while the sheets remain in the offset position;

a first sheet lineup unit configured to line up the sheets in the sheet transporting direction; and a second sheet lineup unit configured to line up the sheets in a direction perpendicular to the sheet transporting direction, wherein the first sheet lineup unit includes a stopper that engages leading edges of the sheets ejected onto the stack tray from the offset transport unit and a drive unit configured to adjust a position of the stopper, the second sheet lineup unit includes a pair of joggers configured to jog the sheets ejected by the offset transport unit onto the stack tray to the offset position, and a pair of sheet fences configured to engage the sheets to be jogged by the pair of joggers into the offset position, the pair of sheet fences are disposed inside the pair of joggers and are pivotally supported by support members at upper ends thereof, one of the pair of sheet fences corresponding to a side on which the sheets are ejected from the offset transport unit rotates upwardly by being pushed by an upper surface of the sheets ejected from the offset transport unit while the sheets remain in the offset position, and a jogger on a side of the sheet fence that rotates upwardly by being pushed by the upper surface of the sheets between the pair of joggers makes contact with ends on one side of the sheets that are ejected and jogs the sheets to the offset position, and ends on other side of the sheets are brought into contact with the other sheet fence so that the offset position of the sheets is engaged.

2. The sheet processing device according to claim 1, wherein the sheet fences include oblique portions extending obliquely downward from the upper ends pivotally supported by the support members so that the sheet fences are swung upward by being pushed by the sheet which is being ejected, and front end portions formed in a circularly curved shape.

3. The sheet processing device according to claim 1, wherein a contact position of the jogger that jogs the sheets to the offset position and a contact position of the sheet fence that engages the offset position of the sheets deviate from each other in the sheet transporting direction, the contact position of the jogger is forward of the contact position of the sheet fence in the sheet transporting direction, and the offset position of the sheets is engaged by the contact position of the jogger and the contact position of the sheet fence.

4. A stacker comprising the sheet processing device according to claim 1.

* * * * *